US008839568B2

(12) United States Patent
Molander et al.

(10) Patent No.: US 8,839,568 B2
(45) Date of Patent: Sep. 23, 2014

(54) MULTI-DWELLING STRUCTURE

(71) Applicant: Pac West Properties Inc., Saskatoon, CA (US)

(72) Inventors: Peter Molander, Surrey (CA); Tammy Monsell, Surrey (CA); Gordon Guthrie, Mission (CA)

(73) Assignee: Pac West Properties Inc., Saskatoon (CA)

( * ) Notice: Subject to any disclaimer, the term of this patent is extended or adjusted under 35 U.S.C. 154(b) by 0 days.

(21) Appl. No.: 14/069,907

(22) Filed: Nov. 1, 2013

(65) Prior Publication Data

US 2014/0123574 A1 May 8, 2014

(30) Foreign Application Priority Data

Nov. 2, 2012 (CA) ..... 2795035

(51) Int. Cl.
*E04H 1/00* (2006.01)

(52) U.S. Cl.
CPC ..... *E04H 1/005* (2013.01)
USPC ..... 52/79.12; 52/79.5

(58) Field of Classification Search
CPC . E04B 1/34331; E04B 1/343; E04B 1/34384; E04B 1/34869; E04H 1/00; E04H 15/18; E04H 9/14
USPC ..... 52/79.12, 79.5
See application file for complete search history.

(56) References Cited

U.S. PATENT DOCUMENTS

| | | | | |
|---|---|---|---|---|
| 3,869,836 | A * | 3/1975 | Allen | 52/23 |
| 4,229,914 | A * | 10/1980 | Lucas | 135/124 |
| 5,600,923 | A * | 2/1997 | Riley | 52/79.9 |
| 5,706,615 | A * | 1/1998 | Bridges et al. | 52/105 |
| 5,964,065 | A * | 10/1999 | Migurski et al. | 52/64 |
| 8,429,871 | B2 * | 4/2013 | Ingjaldsdottir et al. | 52/582.1 |
| 2002/0038529 | A1 * | 4/2002 | Nelson | 52/2.22 |
| 2003/0024686 | A1 * | 2/2003 | Ouellette | 165/47 |
| 2006/0101730 | A1 * | 5/2006 | Sprung | 52/82 |
| 2007/0209291 | A1 * | 9/2007 | Perez | 52/23 |
| 2010/0305393 | A1 * | 12/2010 | Akers et al. | 600/21 |
| 2011/0016802 | A1 * | 1/2011 | Wallance | 52/79.9 |
| 2011/0023379 | A1 * | 2/2011 | Ligas et al. | 52/2.22 |
| 2013/0014450 | A1 * | 1/2013 | Esposito | 52/11 |

* cited by examiner

*Primary Examiner* — Mark Wendell
(74) *Attorney, Agent, or Firm* — Gordon & Jacobson, PC

(57) ABSTRACT

A structure which includes a frame and a membrane covering the frame to define an interior space, the interior space housing one or more building structures. The building structures are primarily intended for temporary residential purposes but can be configured for communal, recreational, office, medical services, storage or other purposes.

20 Claims, 10 Drawing Sheets

MULTI-DWELLING STRUCTURE

CROSS-REFERENCE TO RELATED APPLICATIONS

This application claims priority from Canadian Patent Application 2,795,035 filed on Nov. 2, 2012 which is hereby incorporated by reference in its entirety.

FIELD

The present invention relates to a multi-dwelling structure.

BACKGROUND

In areas where permanent housing is in short supply or unavailable there are limited options, particularly when large number of people are required to be housed in a short time-frame. Construction, zoning and preparing supporting infrastructures can be costly, take years, and are not easily scalable. Such situations can occur because of remote worksite needs, emergency situations, and even large scale event hosting.

Current solutions include erecting tent cities, transporting and installing trailers, portable buildings, prefabricated housing units, or barrack style set ups. These structures are basic, utilitarian, and impersonal, and for the most part are intended to be temporary housing. Depending on the number of people being housed and the number of housing units, the setup can be sprawling and occupy large expanses of land. Often dining areas, bathroom units and recreational stations are located some distance from the sleeping units, or even placed elsewhere. Due to the sprawling nature of the setup, infrastructure and services can be limited and rudimentary. Moreover, while such setups are intended to be temporary, for a variety of reasons, people may end up residing in such temporary structures for extended periods of time.

Furthermore, when the pressure on housing supply is alleviated, or the housing is no longer needed, temporary housing solutions such as tent cities and trailer parks are difficult to dismantle or remove particularly from remote locales. Even when removed, there can be significant environmental damage where large tracts of land have been occupied.

There is a need for cost effective housing that is portable, quickly assembled and scalable, yet is comfortable and can be inhabited for longer periods of time.

SUMMARY

There is provided a structure which has a frame, with a membrane covering the frame to form an exterior shell that defines an interior space. At least one building structure is positioned within the interior space and can be configured for many desirable purposes.

The at least one building structure preferably comprises a plurality of units that can be secured together in end to end relation or can be stacked.

Preferably, the units further include a chase passage to receive at least one of a duct, a water supply pipe, and electrical wiring.

BRIEF DESCRIPTION OF THE DRAWINGS

These and other features will become more apparent from the following description in which reference is made to the appended drawings, the drawings being for the purpose of illustration only and not intended to be in any way limiting, wherein.

DETAILED DESCRIPTION

A multi-dwelling structure will now be described with reference to FIG. 1 through 10.

Figure 1:
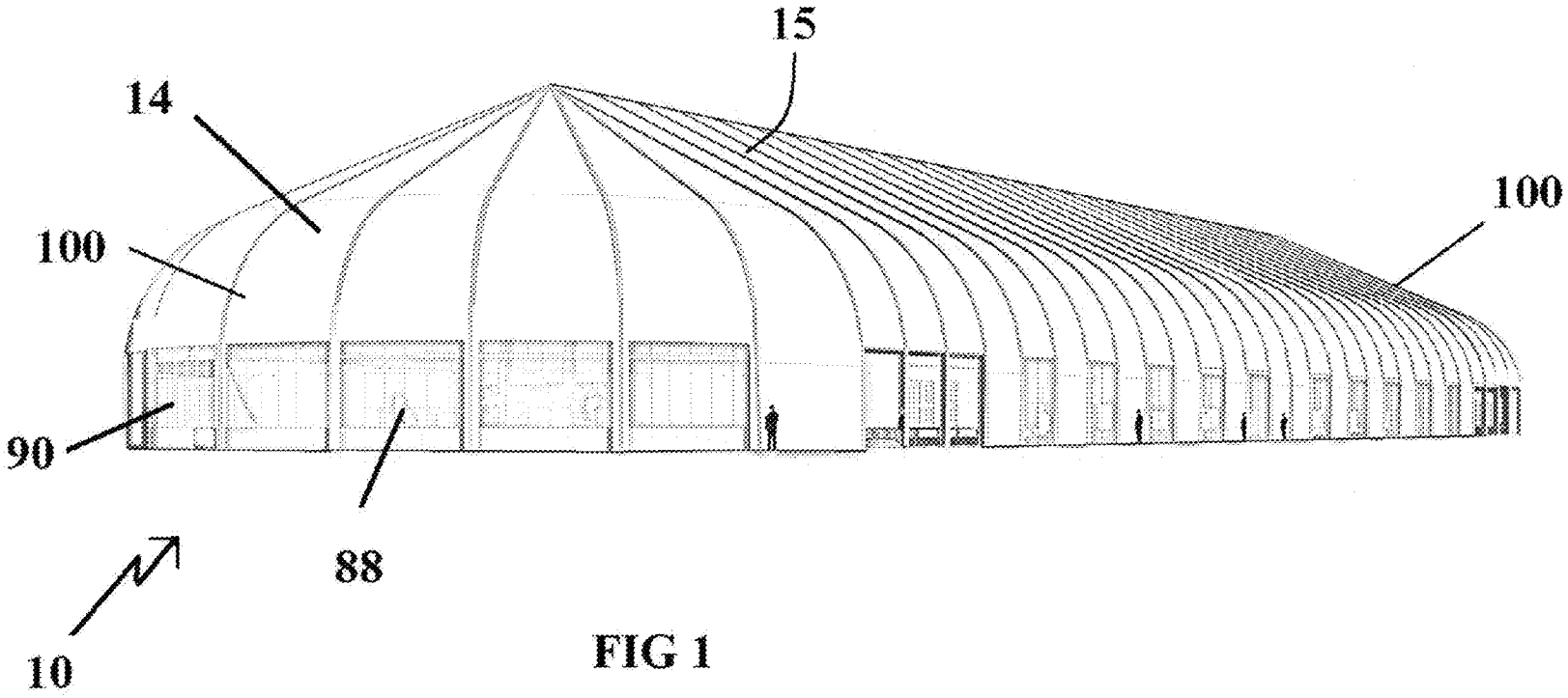
FIG. 1 is a perspective view of a multi-dwelling structure.
Figure 2:
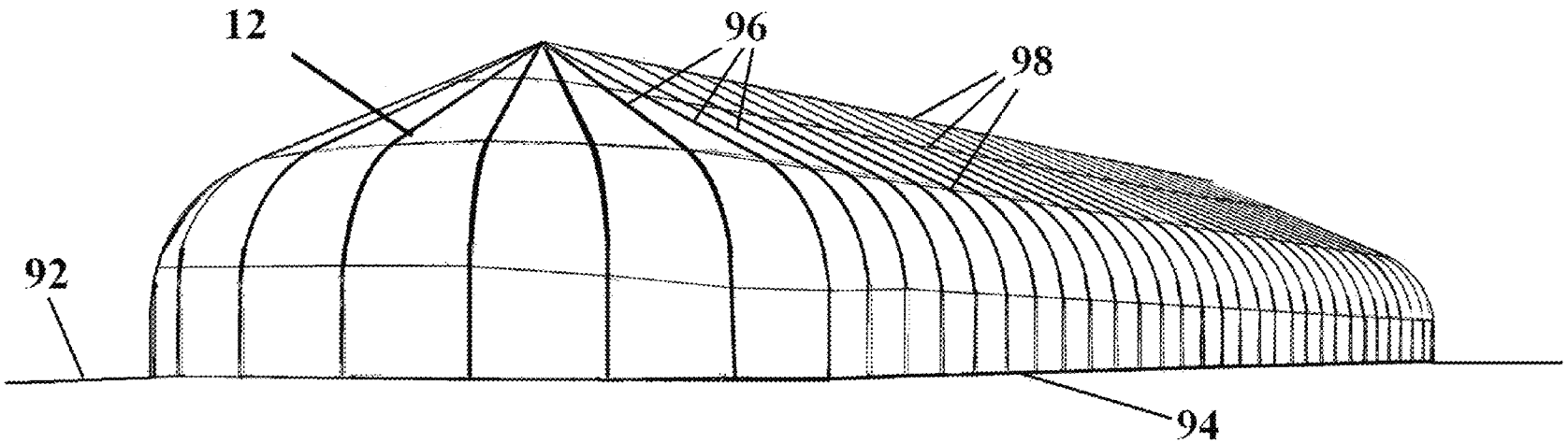
FIG. 2 is a perspective view of the frame of the multi-dwelling structure.

Referring to FIG. 1, there is illustrated a multi-dwelling structure generally referenced by the numeral 10. The multi-dwelling structure 10 includes a frame 12 as illustrated in FIG. 2 with a tensile fabric membrane 14 covering the frame 12 to form an exterior shell 15 that defines an interior space 16 as shown in FIG. 3.

Figure 3:
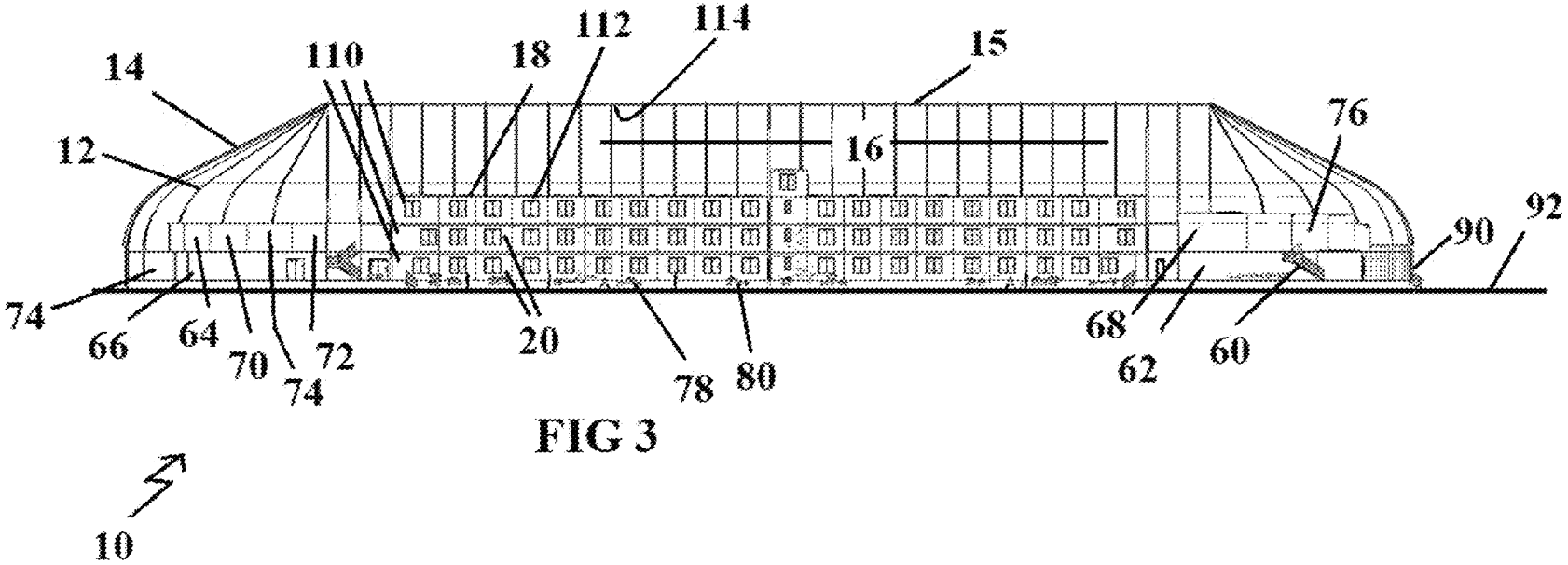
FIG. 3 is a side view, in section, of the multi-dwelling structure with a housing structure within.

Referring to FIG. 3, a housing structure 18 is positioned within the interior space 16. Housing structure 18 is enclosed by exterior shell 15. Although a single housing structure 18 is shown, it will be appreciated that there could be several housing structures 18 located within the interior space 16.

Figure 6:
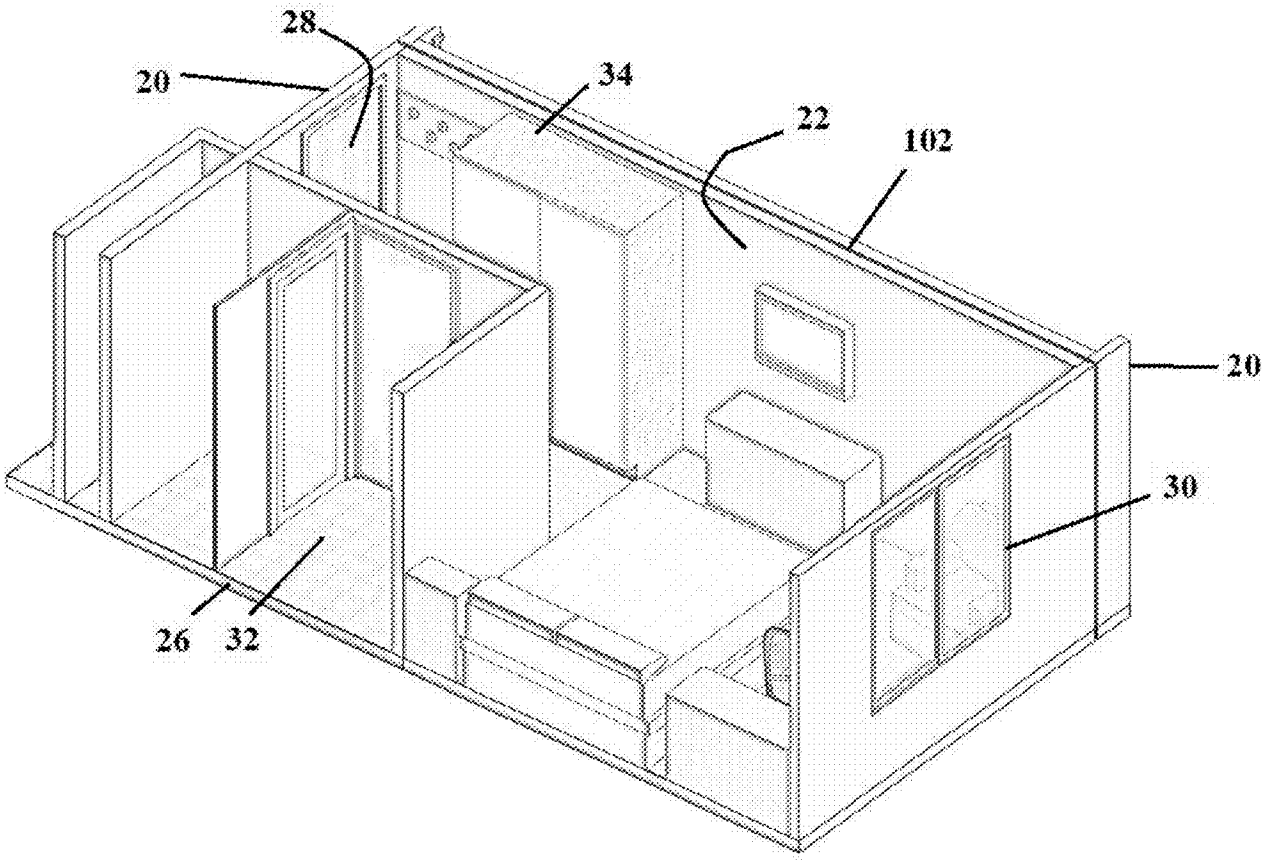
FIG. 6 is a perspective view of the interior of a living unit from above.
Figure 7:
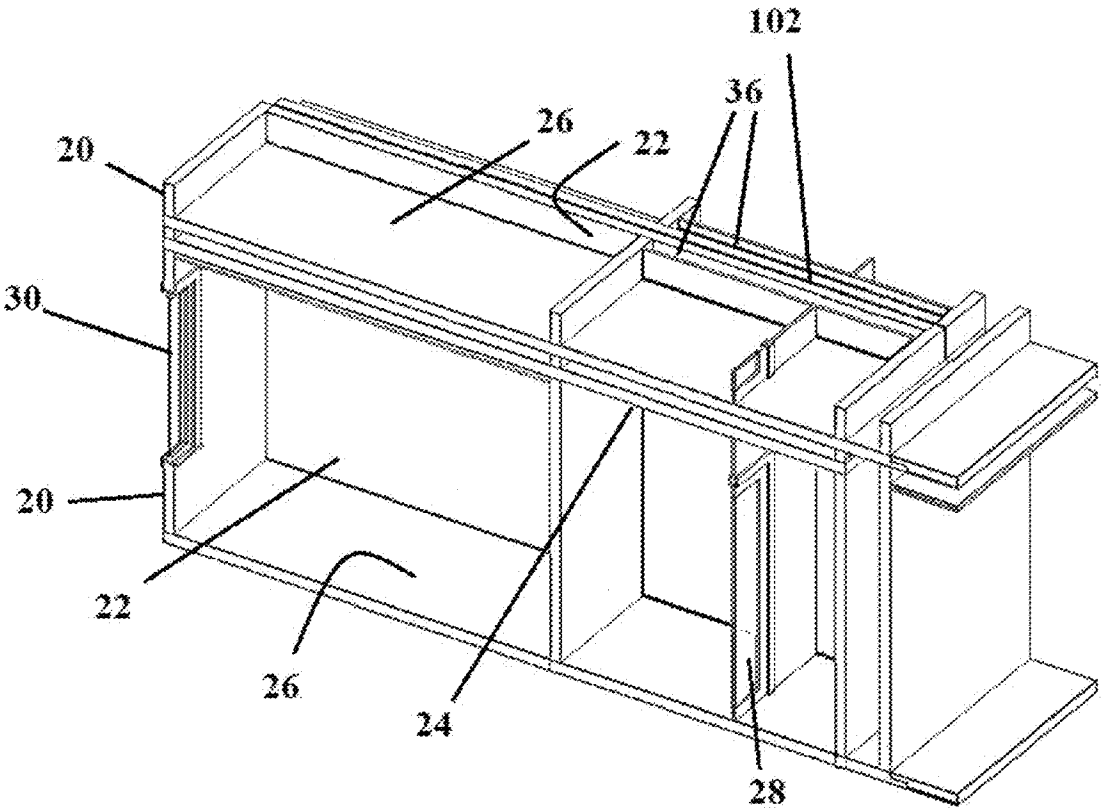
FIG. 7 is detailed section view of one end of a living unit.
Figure 8:
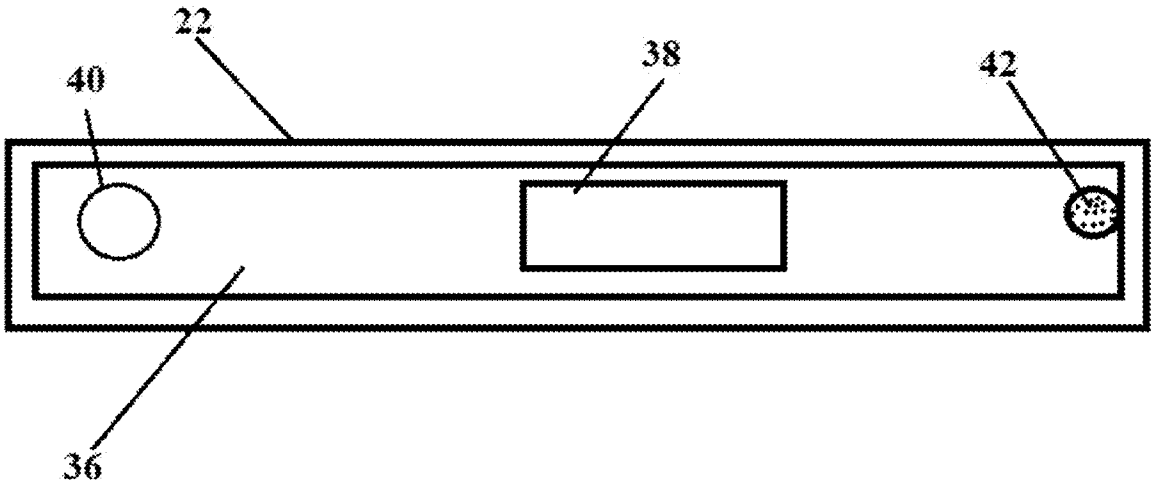
FIG. 8 is a top plan view of the chase containing wires, pipe and ducts.
Figure 9:
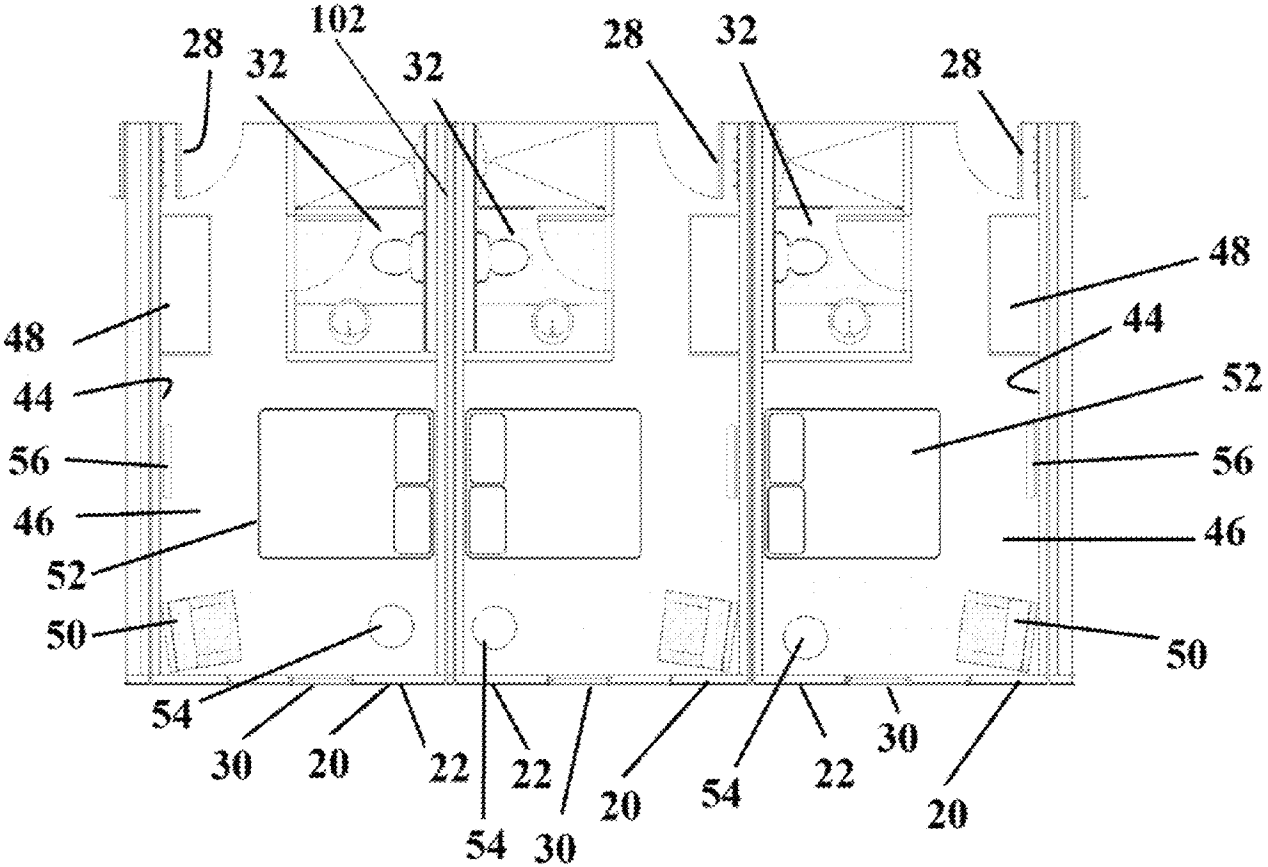
FIG. 9 is a top plan view of the living units secured together in side by side relation.

Referring again to FIG. 3, the housing structure 18 is comprised of individual prefabricated living units 20. The individual prefabricated living units 20 are secured together to form the housing structure 18. Units 20 can be secured together in end to end relation as shown in FIG. 3 and FIG. 9, side to side relation, or stacked on top of each other horizontally as shown in FIG. 3 as per the preferred design. Referring to FIG. 6 and FIG. 7, each of the individual prefabricated living units 20 is comprised of walls 22, a ceiling 24, a floor 26 and at least one egress such as a doorway 28. Windows 30 or similarly ventilated openings can also be provided in the walls 22. Referring to FIG. 9, each of the individual prefabricated living units 20 may also include a separate bathroom 32 and closet 34 as illustrated in FIG. 6. Each prefabricated living unit 20 is provided with a chase passage 36 to receive ventilation and heating ducts 38, sewer and water supply pipes 40, or electrical wiring 42 as illustrated in FIG. 8 to supply the necessary water and electrical services to each living unit 20.

Referring to FIG. 9, the interior of the living units 20 can be customized as desired. Drywall 44 and paint or wall coverings can be provided for aesthetic appeal. Flooring 46 in options such as such as carpet, laminate flooring, or cork can be added to increase comfort. Furniture and standard decorative items such as tables 48, chairs 50, beds 52, lighting 54, and televisions 56 can also be included in each the living units 20. It is envisioned that each living unit 20 would have water, electricity and internet access such as wifi. The living units 20 can be customized to a degree that residents feel as though they are residing in a conventional and comfortable living environment rather than in institutionalized rooms. Particularly in respect of workforce housing, having comfortable living quarters that are similar to a home environment with an uplifting atmosphere and peaceful landscape designs is believed to have a positive impact on workers' mental and physical health, worker retention rates, and increased workplace productivity.

Figure 4:
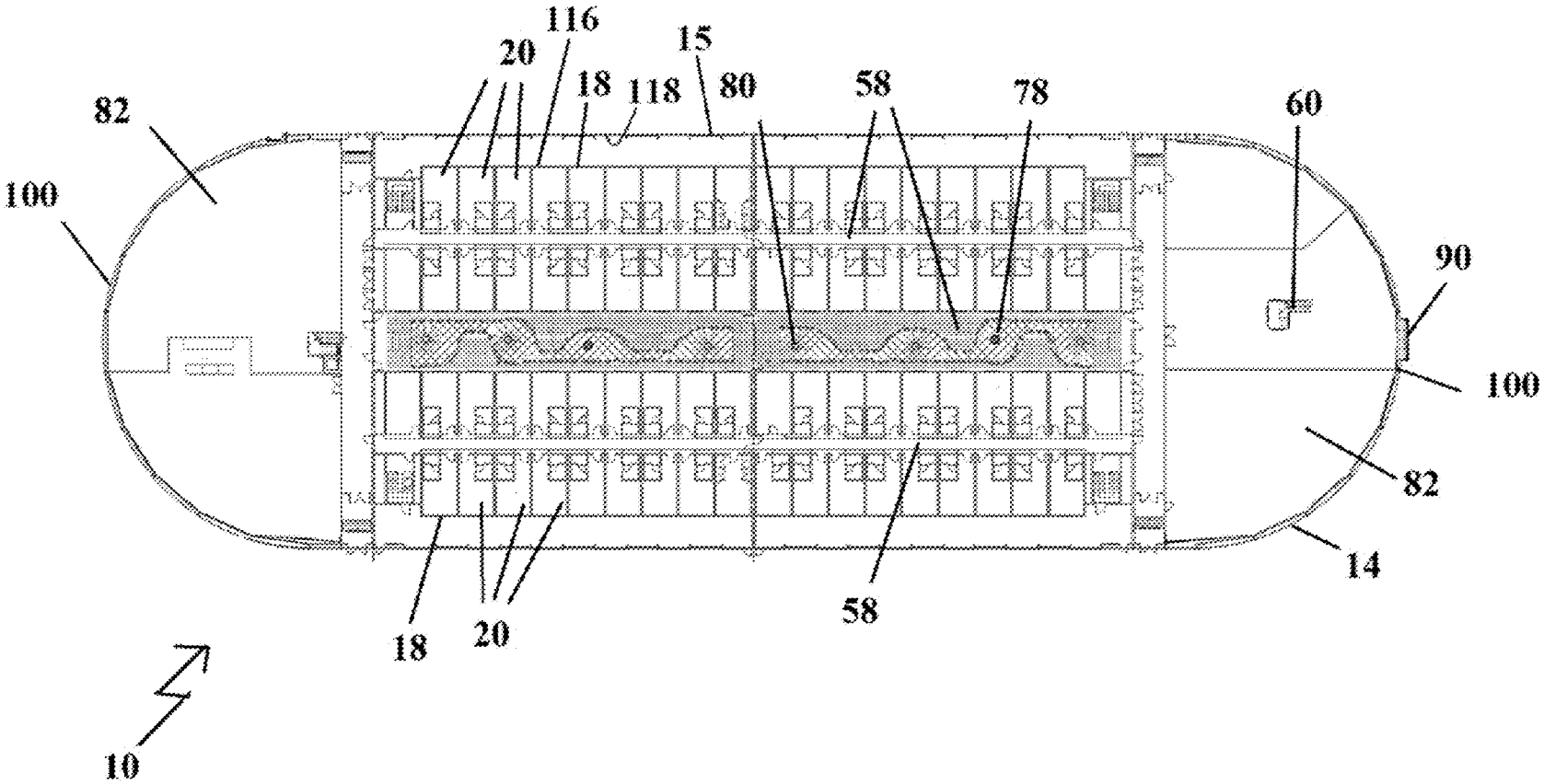
FIG. 4 is a top plan view, in section, of a first level of the housing structure within the multi-dwelling structure.
Figure 5:
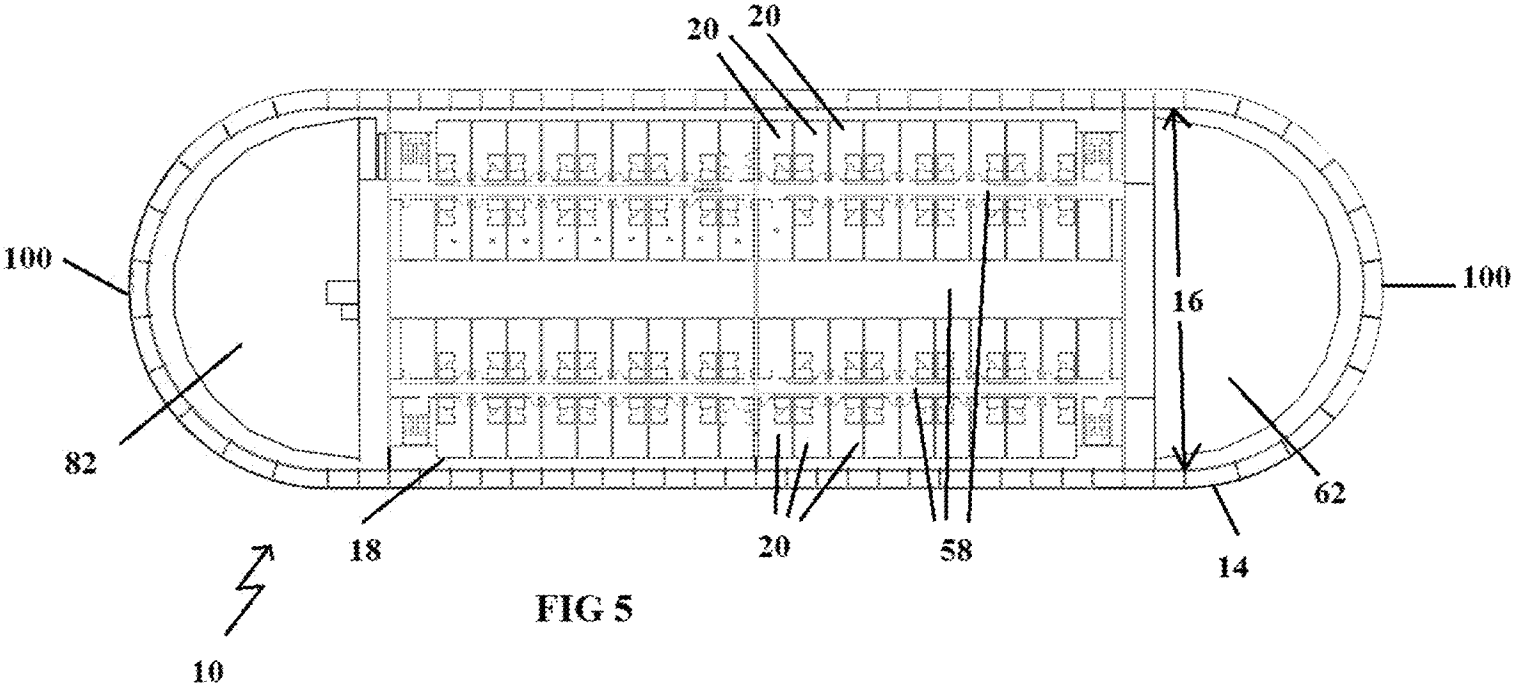
FIG. 5 is a top plan view, in section, of a second level of the housing structure within the multi-dwelling structure.

Referring to FIGS. 4 and 5, walkways 58 and stairways 60 can be added to facilitate movement between and through the housing structure 18. Referring to FIG. 3, the housing structure 18 can include other types of living units 20 such as communal dining rooms 62, gyms 64, exercise rooms 68, meeting rooms 70, medical services areas 72, storage 74, workshops 76 and office spaces 78. Referring to FIG. 4, the units 20 can consist of any amenities as desired. In addition, plants 78 and trees 80 can be incorporated into the common areas 82 and walkways 58 to further add to the aesthetic nature of the multi-dwelling structure 10.

Referring to FIG. 3, the use of prefabricated living units 20 allows for excellent modular flexibility and scalability to design larger or smaller housing structures 18 depending on the number of individuals residing there. It also allows for flexibility in terms of designing housing structures 18 that may have multiple uses in addition to housing people, such as for storage, office and workshop activities, socializing and exercising, dining and other communal activities. Housing structures 18 can also be customized to accommodate the dimensions of the exterior shell 15, the location it is placed in, the available land size, and duration that they are required for. Being modular allows for unique layouts of living units 20 to minimize the institutionalised look and feel of many mass housing structures and dormitory style buildings. Accordingly, units 20 can be brought in and removed as necessary allowing housing structures 18 to be scaled up and down quickly and with minimal disruption.

In locations where transporting such prefabricated units 20 is difficult or impossible, partially assembled units such as wall panels 84 and ceiling panels 86 can be transported to the site and assembled on-site.

Referring to FIG. 6, in the illustrated embodiment, prefabricated bedroom units 20 can be around 220 square feet, however it will be appreciated that other dimensions can also be used. All prefabricated units 20 are intended to be constructed to be compliant with national and regional building codes.

Referring to FIG. 6 and FIG. 7, in the illustrated embodiment, the prefabricated living units 20 are constructed of cross laminated timber (CLT). CLT is a preferred environmental choice for housing because of its cross-layered construction, reduced carbon footprint, and use of beetle killed lumber. Cross laminated timber panels are ideal for use in floor, wall, and roof systems. CLT is 6 times lighter than and a third thinner than concrete making it more portable. It is cost competitive against steel and concrete and reduces overall construction time. Finally there is a safety advantage in that the burn rate for CLT is 2 hours. It will be appreciated that other known types of materials could also be used to effectively construct the prefabricated living units 20.

Referring to FIG. 3, because the living units 20 can be stacked into several levels of living spaces, the multi-dwelling structure 10 of the present invention provides a smaller overall physical and environmental footprint than some existing solutions.

Referring again to FIG. 3, as the housing structure 18 is fully enclosed within the interior space 16 defined by the exterior shell 15, a centralized heating and cooling system can be used. As result, less infrastructure is required for each of the individual living units 20. Centralized heating and cooling can be run off generators or off existing grid sources. Heating and cooling can be augmented by electric heat and cooling options in individual units such that residents can adjust their respective living unit to a preferred temperature.

Moreover, any electrical wiring 42, water pipes 40, or ductwork 38 as illustrated in FIG. 8 can be located within the frame 12 and overlying tensile fabric membrane 14 shown in FIG. 3, and are sheltered from outside environmental elements, as are the living units 20 themselves. This protects them from weather damage and as a result the living units 20 last up to 10 times longer than other solutions. As they last longer, once they are disassembled from the housing structure 18, they can be reused.

Referring to FIG. 1 and FIG. 3, another advantage of the multi-dwelling structure 10 is that the tensile fabric membrane 14 has a water shedding facility that can be used as part of a process to capture rainwater. It is envisioned that the multi-dwelling structure 10 could incorporate a number of systems to aid in self sufficiency such as hydroponic and vertical growing systems for plants and vegetables, solar collection for power, and water collection systems for supplying water. Other types of known systems can also be incorporated.

Referring to FIG. 1, the tensile fabric membrane 14 can further include transparent or translucent panels 88 which can allow for sunlight to pass through. This may be desirable particularly in common areas of the multi-dwelling structure 10 and where growing systems and interior plants and trees require sunlight.

Figure 10:
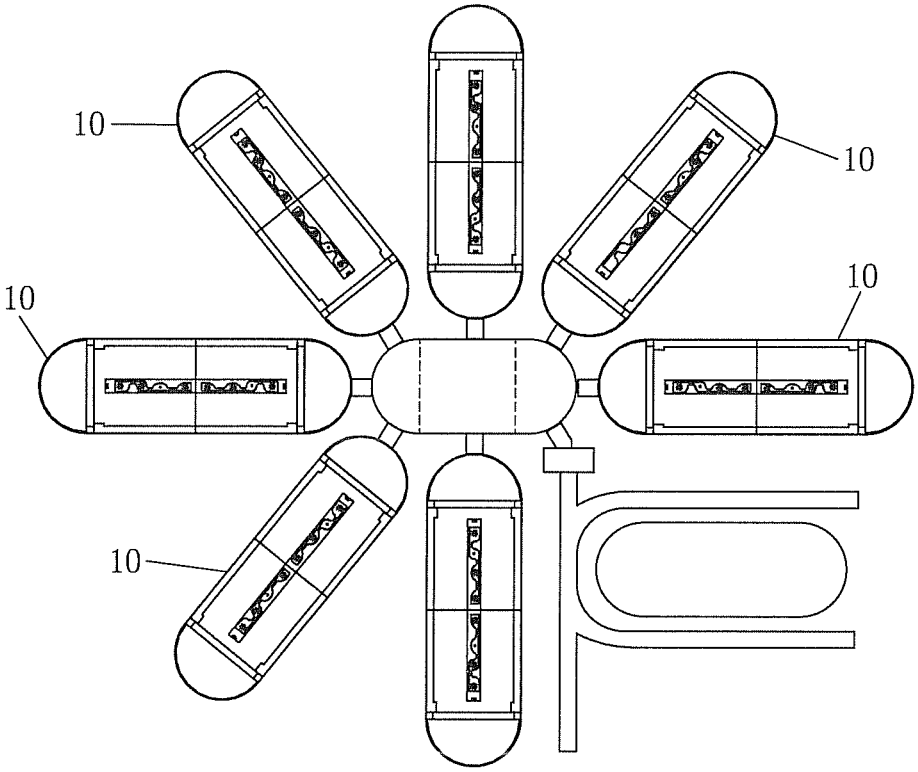
FIG. 10 is a top plan view of an example of a layout of a number of multi-dwelling structures.

Referring to FIG. 3, it will be noted that the housing structure 18 is positioned within the interior space 16 such that frame 12 and tensile fabric membrane 14 fully enclose the housing structure 18. There are closable openings 90 in tensile fabric member 14 that permit people, equipment and vehicles to enter and leave the multi-dwelling structure 10. There are several benefits to this closed environment provided by the frame 12 and overlying tensile fabric membrane 14. Environmental conditions such as heat, cooling and humidity can be controlled within the inner space 16 of the frame 12 and overlying tensile fabric membrane 14. This means that there are fewer infrastructures to put in place within each of the individual living units 20 resulting in less costs, faster construction time, and smaller footprint. Because of the encapsulated nature of the multi-dwelling structure 10, the multi-dwelling structure can be pressurized for comfort even in higher altitudes. Air quality can be adjusted for oxygen content if necessary. If there are very large numbers of people to be housed, several multi-dwelling structures 10 can be erected in a variety of layouts as shown in FIG. 10.

A further benefit is that because of the modular nature of the multi-dwelling structure 10, it allows for quick and cost effective mobilization and demobilization. When removed, nothing need remain behind and the land utilized can be reused or returned to its original state. As permanent infrastructures are not in place, removal results in very little damage to the structure 10 or the surrounding environment. In rare situations where it may be desirable or necessary to leave some or part of the structure 10 behind, much of it can be repurposed for other uses such as ice rinks, storage, and community centres.

The use and operation of the multi-dwelling structure will now be described with reference to FIGS. 1 through 10. Referring to FIG. 1 and FIG. 2, multi-dwelling structure 10 is set up by first selecting a suitable place to erect the structure 10. It is preferable that the underlying ground surface 92 be level and of suitable stability to support the dimensions and load of a large building.

Referring to FIG. 2, typically a concrete ring 94 is prepared which sets out the parameters of the footpad of the structure 10. The ground surface 92 can be prepared any number of known ways. It is preferable that the underlying ground surface 92 be levelled and compacted to support a building. If desired, a concrete footpad can be laid down, gravel stone can be layered and even geogrids may also be used depending on the location and desired design of the structure 10. In some locations, it may be necessary to provide a frost barrier. Individual concrete footpads and anchors can also be used to support the load of the frame 12.

Referring to FIG. 1 and FIG. 2, these types of frames 12 with overlying tensile fabric membranes 14 are known in the art. Referring to FIG. 2, typically the frame 14 is comprised of a number of arc shaped beams 96 which may be available in widths of 30, 40, 50 and 60 feet, and have spans of 120 feet. Horizontal support beams 98 may be secured to and extend along the frame 12 longitudinally. Arch beams 96 tend to have a height of approximately one-half the width and are normally assembled in modular 10 to 15 foot spaced sections. In the illustrated embodiment 10, the frame 12 is at a height of 60 feet. It will be appreciated that the size and dimensions of the exterior shell 15 can vary depending on the design and housing requirements. The ends 100 of the multi-dwelling structure 10 can be dome-shaped as illustrated in the embodiment 10 or flat (not illustrated).

Referring to FIG. 1, preferably the tensile fabric membrane 14 of impervious material such as PVC coated nylon, polyester, fibre glass, "Teflon"™, "Kevlar"™, polypropylene or the like such that it is resistant to moisture, mildew, insects and such factors, translucent yet treated to withstand extreme temperature changes and to inhibit deterioration from sunlight, and fire retardant being self-extinguishing as well as being tear resistant. The membrane 14 can be assembled in sections or as a whole.

Referring to FIG. 2 and FIG. 3, the frame 12 is covered with a tensile fabric membrane 14 to define an interior space 16. When covering the frame 12, tensile fabric membrane 14 is tensioned over the frame 14 so as to maximize the strength of the total structure 10 such that it will withstand snow and wind loadings. The methods of tensioning the membrane 14 and securing it to the frame 12 are known to the industry.

Referring to FIG. 3, prefabricated living units 20 may be transported into the interior space 16 during the process of covering the frame 12 with the tensile fabric membrane 14. Alternatively they can be transported after the tensile fabric membrane 14 is in place. Living units 20 are then assembled into the housing structure 18 by arranging them in end to end, side by side or stacked relation as desired and securing them together to achieve a desired layout of the housing structure 18 depending on the housing requirements. Units 20 can be secured together with standard construction methods. Referring to FIG. 6, unlike traditional apartment and other dorm style constructions, the modular units 20 in the present housing structured are intended to be assembled with a 1 to 1.5 inch space 102 between adjacent units to provide for sound abatement. Traditionally such units would share a wall; however the modular units 20 of the present invention each have their own walls 22 with a sound abatement space 120 provided between. This can be important in high density housing where sounds can amplify with poor design and shared walls.

Referring to FIG. 4 and FIG. 5, as per the preferred design, walkways 58, common areas 82 and stairways 60 can be added. Referring to FIGS. 7 and 8, infrastructure elements such as electrical wiring 42 and plumbing pipes 40 can be provided to each unit 20 through chases 36. Water and electricity can be supplied from existing sources on the grid, or can be provided by other known independent sources off the grid. As discussed above, each living unit 20 can be further finished or customized as desired. Referring to FIG. 6, in the illustrated embodiment, units 20 are 220 square feet, although it will be appreciated that they can be of other sizes as per design. Referring to FIG. 3, once the housing structure 18 is assembled, central heating and air conditioning can be supplied to the interior space 16 as described above. The multi-dwelling structure 10 is suitable for occupation for short or long periods of time.

Referring to FIG. 3, housing structure 18 can be several stories 110 as permitted by building codes. This is an advantage over existing single layer housing which must be spread out over a large territory. As housing units 20 can be stacked into stories 110, a smaller footprint is required while maximizing housing density. Although the exterior shell 15 could be of varying heights and perimeters, in the illustrated embodiment 10, the exterior shell 15 is 60 ft in height, 130 ft wide, a length that varies between 350 ft to 600 ft. The housing structure 10 contained within the exterior shell 15 has three stories 110. It is preferred that an air space be provided between the top 112 of the housing structure 18 and the top 114 of the exterior shell 15 and between the sides 116 of the housing structure 10 and the sides 118 of the exterior shell 15. In the illustrated embodiment, a space of 20 to 30 feet is provided between the top 112 of the housing structure 18 and the top 114 of the exterior shell 15 to accommodate the design of the housing structure and the shape of the shell 15. Referring to FIG. 4, in the illustrated embodiment 10, the space between the sides 116 of the housing structure 10 and the sides 118 of the exterior shell 15 can vary from 8 to 10 feet. This allows for adequate interior circulation of controlled air as well as providing passageways for residents.

When there comes a time that the multi-dwelling structure 10 is no longer needed, the housing structure 18 can be disassembled. Individual living units 20 can be transported to another location for reuse. Furniture and infrastructure elements also can be removed and also transported to another location for reuse. Frame 12 and tensile fabric membrane 14 can be dismantled and reused as well. It is envisioned that all structure elements are more easily removable as compared to permanent structures. The physical footprint left by the multi-dwelling structure 10 is much smaller than what would have been left by current single layer housing options, and therefore the occupied area is more easily returned to its natural environmental state.

Overall, the multi-dwelling structure 10 provides proven durability and design flexibility coupled with exceptional speed of construction and lower operation costs. The nature of the construction materials and the manner of assembly provides affordability at a price point competitive with other solutions. The multi-dwelling structure 10 has considerable environmental advantages as no permanent environmental damage is created by putting in permanent infrastructures. Furthermore, by enclosing the housing structure 18 within the exterior shell 15, the living units 20 have superior sound abatement and energy efficiencies. It is estimated that there is an energy savings of 25% to 40% over traditional sources by encapsulating the housing structure 18 within the exterior shell 15 and providing central heat and air conditioning.

The multi-dwelling structure 10 as described above is suitable for workforce housing, and it is envisioned that it could also be used to provide housing for emergency situations, army deployments, large scale event hosting where hotels room supplies are not sufficient, and any situation where that housing needs are required on a rapid and efficient basis.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A structure comprising:

a stand-alone frame;

a membrane attached to the frame, defining a functional, climate controlled interior space; and at least one building structure positioned within the interior space and structurally independent of the frame.

2. The structure of claim 1, wherein:

the at least one building structure comprises a residential unit.

3. The structure of claim 2, wherein:

the at least one building structure comprises a bathroom.

4. The structure of claim 1, wherein:

the at least one building structure comprises a plurality of building structures secured together in end to end relation.

5. The structure of claim 1, wherein:

the at least one building structure comprises a plurality of building structures secured together horizontally.

6. The structure of claim 1 wherein:

the at least one building structure comprises walls, a ceiling, a floor and at least one egress.

7. The structure of claim 1, wherein:

the at least one building structure comprises a chase passage to receive at least one of a duct, a water supply pipe, and electrical wiring.

8. The structure of claim 1, wherein:

the at least one building structure comprises at least one communal room.

9. The structure of claim 1, wherein:

the at least one building structure comprises at least one gym.

10. The structure of claim 1, wherein:

the at least one building structure comprises at least one exercise room.

11. The structure of claim 1, wherein:

the at least one building structure comprises at least one meeting room.

12. The structure of claim 1, wherein:

the at least one building structure comprises at least one medical services area.

13. The structure of claim 1, wherein:

the at least one building structure comprises at least one storage room.

14. The structure of claim 1, wherein:

the at least one building structure comprises at least one workshop.

15. The structure of claim 1, wherein:

the at least one building structure comprises at least one office space.

16. The structure of claim 1, wherein:

the at least one building structure comprises at least one recreational rink.

17. The structure of claim 1, wherein:

the at least one building structure is positioned within the interior space such that the frame and membrane fully enclose the building structure.

18. A method of constructing a structure comprising:

erecting a stand-alone frame;

attaching a membrane to the frame to define a functional, climate-controlled interior space; and providing a building structure enclosed within the interior space, the building structure structurally independent of the frame.

19. The structure of claim 1, wherein the frame is self-supporting.

20. The method of claim 18, wherein the erected frame is self-supporting.

* * * * *